US011462350B2

(12) United States Patent
Takahashi

(10) Patent No.: US 11,462,350 B2
(45) Date of Patent: Oct. 4, 2022

(54) COIL COMPONENT AND METHOD OF MANUFACTURING THE SAME

(71) Applicant: Murata Manufacturing Co., Ltd., Kyoto-fu (JP)

(72) Inventor: Katsuyuki Takahashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 573 days.

(21) Appl. No.: 16/556,100

(22) Filed: Aug. 29, 2019

(65) Prior Publication Data

US 2020/0082971 A1 Mar. 12, 2020

(30) Foreign Application Priority Data

Sep. 11, 2018 (JP) ..... JP2018-169293

(51) Int. Cl.
*H01F 27/28* (2006.01)
*H01F 17/04* (2006.01)
(Continued)

(52) U.S. Cl.
CPC ..... *H01F 27/2823* (2013.01); *H01F 17/04* (2013.01); *H01F 41/07* (2016.01);
(Continued)

(58) Field of Classification Search
CPC ..... H01F 27/2823; H01F 41/07; H01F 17/04; H01F 2017/0093; H01F 2027/2838
See application file for complete search history.

(56) References Cited

U.S. PATENT DOCUMENTS 5,868,383 A * 2/1999 Codos ..... F16F 3/04 5/655.8
7,051,770 B2 * 5/2006 Sasaki ..... H01F 41/066 242/444
(Continued)

FOREIGN PATENT DOCUMENTS

CN 103887041 A 6/2014
CN 106298228 A 1/2017
(Continued)

OTHER PUBLICATIONS

An Office Action; "Notice of Reasons for Refusal," mailed by the Japanese Patent Office dated Jul. 20, 2021, which corresponds to Japanese Patent Application No. 2018-169293 and is related to U.S. Appl. No. 16/556,100 with with English translation.
(Continued)

*Primary Examiner* — Michael P McFadden
(74) *Attorney, Agent, or Firm* — Studebaker & Brackett PC

(57) ABSTRACT

A coil component includes a winding core, and a first wire and a second wire that are spirally wound around the winding core, that have substantially the same number of turns, that are not electrically connected to each other, and that have a twisted portion at which the first wire and the second wire are twisted together. In the coil component, the first wire and the second wire are wound around the winding core such that layers are formed. The twist pitch of the twisted portion at a turn in a first layer differs from the twist pitch of the twisted portion at a turn adjacent thereto in a second layer.

20 Claims, 7 Drawing Sheets

(51) Int. Cl.
*H01F 41/07* (2016.01)
*H01F 17/00* (2006.01)

(52) U.S. Cl.
CPC ..... *H01F 2017/0093* (2013.01); *H01F 2027/2838* (2013.01)

(56) References Cited

U.S. PATENT DOCUMENTS

| | | | | |
|---|---|---|---|---|
| 2013/0299250 | A1* | 11/2013 | Baltisberger | G01G 7/02 177/21 OEM |
| 2014/0167903 | A1* | 6/2014 | Tomonari | H01F 27/2823 336/220 |
| 2016/0379756 | A1 | 12/2016 | Yamakita | |
| 2017/0294264 | A1* | 10/2017 | Hashimoto | H01F 27/2823 |
| 2018/0166204 | A1* | 6/2018 | Kobayashi | H01F 17/045 |

FOREIGN PATENT DOCUMENTS

| | | | |
|---|---|---|---|
| CN | 107275041 | A | 10/2017 |
| CN | 108183018 | A | 6/2018 |
| JP | 2017-011132 | A | 1/2017 |
| JP | 2017-188568 | A | 10/2017 |
| JP | 2018-098250 | A | 6/2018 |

OTHER PUBLICATIONS

An Office Action; "Notice of Reasons for Refusal," mailed by the Japanese Patent Office dated Mar. 2, 2021, which corresponds to Japanese Patent Application No. 2018-169293 and is related to U.S. Appl. No. 16/556,100; with English language translation.

* cited by examiner

FIRST LAYER
SECOND LAYER 23
15
16
32
[19]
[17]
[20]
[18]
21
22
24

COIL COMPONENT AND METHOD OF MANUFACTURING THE SAME

CROSS-REFERENCE TO RELATED APPLICATION

This application claims benefit of priority to Japanese Patent Application No. 2018-169293, filed Sep. 11, 2018, the entire content of which is incorporated herein by reference.

BACKGROUND

Technical Field

The present disclosure relates to a coil component and a method of manufacturing the coil component, and particularly, to a coil component that has a structure in which two wires that have twisted portions at which the wires are twisted together are wound around a winding core such that layers are formed, and a method of manufacturing the coil component.

Background Art

An interesting coil component for the present disclosure is disclosed in, for example, Japanese Unexamined Patent Application Publication No. 2017-188568. The coil component disclosed in Japanese Unexamined Patent Application Publication No. 2017-188568 forms, for example, a common mode choke coil and has a structure in which a first wire and a second wire that are twisted together are wound around a winding core. In the coil component disclosed in Japanese Unexamined Patent Application Publication No. 2017-188568, twisted portions at which the first wire and the second wire are twisted together are wound such that layers are formed.

SUMMARY

A methods of winding the first wire and the second wire around the winding core is that the first wire and the second wire are twisted in advance and are wound around circumferential surfaces of the winding core while being guided. Another method thereof is that the first wire and the second wire are wound around the circumferential surfaces of the winding core while being guided and twisted. In any case, the first wire and the second wire are wound around the circumferential surfaces of the winding core after the first wire and the second wire are twisted.

FIGS. 11A and 11B illustrate parts of two twisted portions 3 and 4 with a first wire 1 and a second wire 2 twisted together. In FIGS. 11A and 11B, the first wire 1 is illustrated by hatching to distinguish between the first wire 1 and the second wire 2 clearly. The two twisted portions 3 and 4 illustrated in FIGS. 11A and 11B are adjacent to each other, for example, between a first layer and a second layer with the twisted portions 3 and 4 wound around the winding core.

FIG. 12 is an enlarged diagram illustrating a twist state of a first wire W1 and a second wire W2 for description of a twist pitch, a twist number, a node and an anti-node, which are terms used in the following description of the specification.

In FIG. 12, the first wire W1 is illustrated by hatching, and the second wire W2 is illustrated in outline to distinguish between the first wire W1 and the second wire W2 clearly. In FIG. 12, the twist direction of S-twist is illustrated.

However, there is a case of the twist direction of reversed Z-twist or combination of the Z-twist and the S-twist. In FIG. 12, the first wire W1 and the second wire W2 are twisted together with the first wire W1 and the second wire W2 being close contact with each other. However, as illustrated in FIGS. 11A and 11B, the first wire W1 and the second wire W2 may be twisted together with a space formed therebetween.

It is intended that there are the circumferential surfaces of the winding core beyond the paper in FIG. 12. As illustrated in FIG. 12, when the first wire W1 and the second wire W2 that are twisted are viewed in the direction from the outside of the circumferential surfaces of the winding core to the central axis of the winding core, the first wire W1 and the second wire W2 are twisted at 360 degrees within a length of L. At this time, the twist number of the first wire W1 and the second wire W2 is 1 within the length L. That is, the twist number is defined as the twist number per unit length.

The twist pitch, which is also referred to as a twist pitch length, corresponds to a length when the first wire W1 and the second wire W2 extend from specific relative positions and return to the same relative positions next time with the first wire W1 and the second wire W2 twisted. In other words, the above length L corresponds to the twist pitch.

In FIG. 12, the second wire W2 that is illustrated in outline is above the first wire W1 that is illustrated by hatching within the length L. Such a state is taken as an example for description. When viewed in the direction from the outside of the circumferential surfaces of the winding core to the central axis of the winding core, a point N at which the first wire W1 and the second wire W2 meet is defined as the node, and a point A at which the first wire W1 and the second wire W2 are farthest from each other is defined as the anti-node.

FIG. 11A illustrates a case where the positions of the nodes and the anti-nodes of the two twisted portions 3 and 4 match between the adjacent two twisted portions 3 and 4. FIG. 11B illustrates a case where the positions of the nodes and the anti-nodes of the two twisted portions 3 and 4 do not match between the adjacent two twisted portions 3 and 4. When the first wire 1 and the second wire 2 are wound around the winding core, as illustrated in FIG. 11B, it is likely that the positions of the nodes and the anti-nodes of the two twisted portions 3 and 4 do not match between the adjacent two twisted portions 3 and 4 unless special control is imposed between twisting operation and winding operation described above. The reason is that the twist pitch of the twisted portions 3 and 4 in the first layer is equal to that in the second layer although the length of the circumference of the second layer is longer than the length of the circumference of the first layer. When the positions of the nodes and the anti-nodes of the twisted portion 4 do not match as above, the appearance thereof is bad, the shape of a winding is unstable, and the winding may be unwound.

When the first wire 1, for example, is viewed in a state illustrated in FIG. 11B, the distance between the first wire 1 in the twisted portion 3 and the first wire 1 in the other twisted portion 4 is not stable, and these extremely approach each other or apart from each other. There is a concern that this leads to, for example, increase in volume component and instability, which can occur in the same wire, and degrades mode conversion characteristics of a common mode choke coil.

Various kinds of inconvenience resulted from the above state illustrated in FIG. 11B can be hindrances against achievement of a design that fits the purpose.

In a state illustrated in FIG. 11A, the first wire 1 in the twisted portion 3 and the first wire 1 in the twisted portion 4 are relatively apart from each other, and the distance therebetween is stable. This can be conducive to reduction in the mode conversion characteristics, for example, of the common mode choke coil. However, the state illustrated in FIG. 11A cannot be obtained unless special control is imposed between the twisting operation and the winding operation as described above.

Accordingly, the present disclosure provides a coil component that readily achieves a design that fits to the purpose, and a method of manufacturing the coil component.

According to preferred embodiments of the present disclosure, a coil component includes a winding core, and a first wire and a second wire that are spirally wound around the winding core, that have substantially the same number of turns, that are not electrically connected to each other, and that have a twisted portion at which the first wire and the second wire are twisted together. The twisted portion is wound around the winding core such that layers are formed. Also, a twist pitch of the twisted portion at a turn in a first layer differs from a twist pitch of the twisted portion at a turn adjacent thereto in a second layer.

According to preferred embodiments of the present disclosure, a method of manufacturing a coil component is also provided.

According to preferred embodiments of the present disclosure, a method of manufacturing a coil component includes a step of preparing a winding core, a step of preparing a first wire and a second wire, a first winding step of spirally winding the first wire and the second wire around the winding core after the first wire and the second wire are twisted together, and a second winding step of spirally winding the first wire and the second wire around the winding core while the first wire and the second wire are twisted together such that the first wire and the second wire are stacked on the first wire and the second wire that are wound at the first winding step.

Also, in the method of manufacturing the coil component, a twist pitch of the first wire and the second wire that are twisted at the second winding step differs from a twist pitch of the first wire and the second wire that are twisted at the first winding step.

According to preferred embodiments of the present disclosure, the twist pitch of the twisted portion at a turn in the first layer differs from the twist pitch of the twisted portion at a turn adjacent thereto in the second layer. This improves the degree of freedom of design.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIG. 11A illustrates a case where nodes and anti-nodes of one of the two adjacent twisted portions are aligned with those of the other twisted portion. FIG. 11B illustrates a case where the nodes and the anti-nodes of one of the adjacent two twisted portions are not aligned with those of the other twisted portion.

DESCRIPTION OF THE PREFERRED EMBODIMENTS

According to the present disclosure, the twist pitch of twisted portions at a turn in a first layer differs from the twist pitch of the twisted portions at a turn adjacent thereto in a second layer as described above. This improves the degree of freedom of design.

For example, this prevents the nodes and the anti-nodes of the twisted portions from being misaligned, makes the appearance good, prevents a winding from being unwound, and makes the shape of the winding stable. To make the shape of the winding stable, it is not necessary that the nodes and the anti-nodes are aligned in the entire twisted portions, but only parts thereof suffice, that is, it is only necessary that there are parts at which the shape of the winding is stable.

The improvement in the degree of freedom of design as above readily achieves a winding state that enables increase in volume component and instability, which can occur in the same wire in the first layer and the second layer that are adjacent to each other, to be reduced, for example, when the twisted portions at which a first wire and a second wire are twisted together are wound around a winding core such that layers are formed. Accordingly, the mode conversion characteristics of, for example, a common mode choke coil can be reduced.

A coil component 11 according to a first embodiment of the present disclosure will be described with reference to FIG. 1 to FIG. 5. The coil component 11 illustrated forms, for example, a common mode choke coil.

Figure 1:
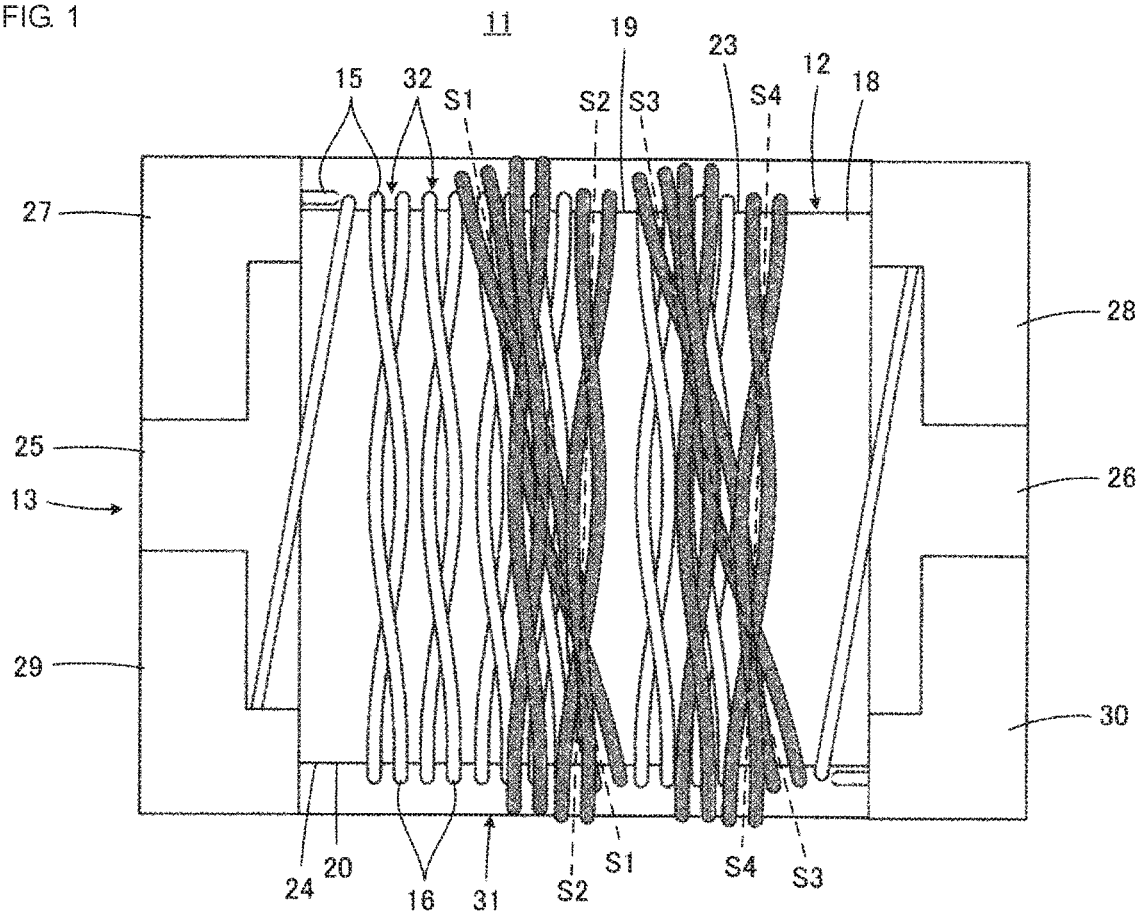
FIG. 1 is a bottom view of a coil component according to a first embodiment of the present disclosure viewed from a mounting surface.

As illustrated in FIG. 1, the coil component 11 includes a drum-shaped core 13 that includes a winding core 12. The coil component 11 also includes a first wire 15 and a second wire 16 that are disposed around the winding core 12. Among twisted portions 32 of the first wire 15 and the second wire 16, the twisted portions 32 that are in direct contact with the winding core 12 and that are directly wound mainly around the winding core 12 form the first layer. In FIG. 1, the first wire 15 and the second wire 16 in the first layer are illustrated in outline. The twisted portions 32 that are wound on the first layer around the winding core 12 form the second layer. In FIG. 1, the first wire 15 and the second wire 16 in the second layer and the first wire 15 and the second wire 16 between the first layer and the second layer are illustrated by hatching.

The drum-shaped core 13 is composed of a nonconductive material, more specifically, a non-magnetic material such as alumina, a magnetic material such as Ni—Zn ferrite, or a resin. Examples of the resin include a resin that contains magnetic powder such as metal powder or ferrite powder, a resin that contains non-magnetic material powder such as silica powder, and a resin that contains no filler such as powder.

Each of the wires 15 and 16 is composed of a linear central conductor of a copper wire that is covered with an electrical insulation resin such as polyurethane, imide modified polyurethane, polyester imide, or polyamide imide and that has a diameter of, for example, no less than 0.02 mm and no more than 0.08 mm (i.e., from 0.02 mm to 0.08 mm).

Figure 2:
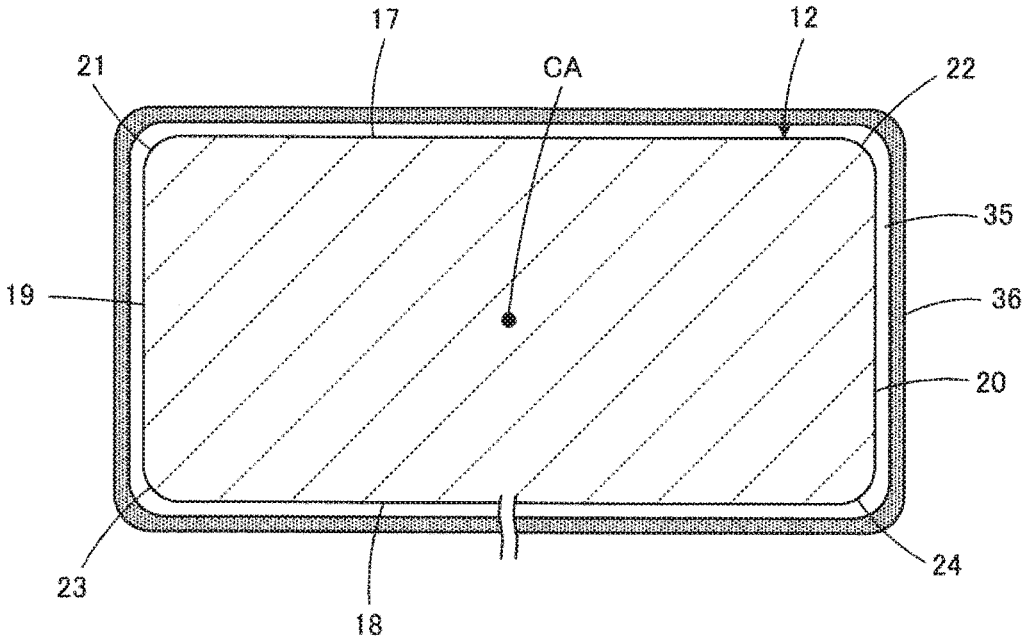
FIG. 2 illustrates wire-like bodies that are wound around a winding core of the coil component illustrated in FIG. 1 such that two layers are formed, and is a sectional view of a surface perpendicular to the central axis of the winding core, and the lines schematically represent two wires that are twisted together.
Figure 3:
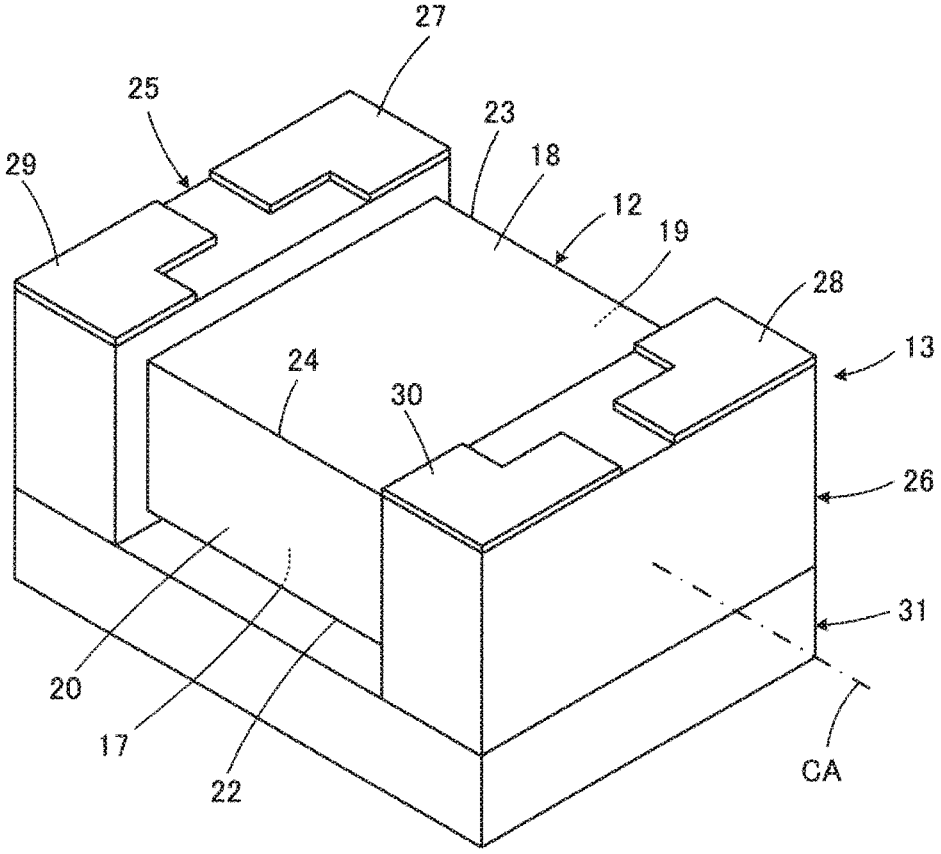
FIG. 3 is a perspective view of the coil component illustrated in FIG. 1 from which only a drum-shaped core and a plate core are removed with the mounting surface facing upward.

As illustrated in FIG. 2 and FIG. 3, the winding core 12 has circumferential surfaces that are formed about the central axis CA. The sectional shape of the winding core 12 along a plane perpendicular to the central axis CA is substantially quadrilateral. Accordingly, the circumferential surfaces of the winding core 12 include four flat surfaces extending in the direction of the central axis CA, that is, a top surface 17 and a bottom surface 18 that face each other, and a first side surface 19 and a second side surface 20 that are adjacent to the top surface 17 and the bottom surface 18 and that face each other.

A length direction is defined as the direction of the central axis CA. A thickness direction is defined as a direction in which a plate core 31 described later and flange portions 25 and 26 described later come into contact with each other, the direction being perpendicular to the central axis CA. A width direction is defined as a direction perpendicular to the length direction and the thickness direction.

Regarding dimensions that are measured in the circumferential direction of the winding core 12, that is, in a direction in which the circumferential surfaces that are formed about the central axis CA are connected to each other, for example, the dimension of the side surfaces 19 and 20 is about 0.6 mm, the dimension of the top surface 17 and the bottom surface 18 is about 1.2 mm, and one round is about 3.6 mm. A dimension in the length direction that is measured in the direction of the central axis CA of the winding core 12 is, for example, about 2.0 mm.

A first ridge line 21 and a second ridge line 22 extend in the direction of the central axis CA along a first edge portion and a second edge portion that are opposite each other in the circumferential direction of the above top surface 17. A third ridge line 23 and a fourth ridge line 24 extend in the direction of the central axis CA along a first edge portion and a second edge portion that are opposite each other in the circumferential direction of the bottom surface 18. The first ridge line 21 and the third ridge line 23 extend in the direction of the central axis CA along a first edge portion and a second edge portion that are opposite each other in the circumferential direction of the first side surface 19. The second ridge line 22 and the fourth ridge line 24 extend in the direction of the central axis CA along a first edge portion and a second edge portion that are opposite each other in the circumferential direction of the second side surface 20.

In a description from a different perspective, the interface between the top surface 17 and the first side surface 19 that are adjacent to each other is referred to as the first ridge line 21, and the interface between the top surface 17 and the second side surface 20 that are adjacent to each other is referred to as the second ridge line 22. The interface between the bottom surface 18 and the first side surface 19 that are adjacent to each other is referred to as the third ridge line 23. The interface between the bottom surface 18 and the second side surface 20 that are adjacent to each other is referred to as the fourth ridge line 24. The ridge lines 21 to 24 may be chamfered so as to be rounded as illustrated in FIG. 2, may be chamfered so as to have an inclined surface, or may be chamfered so as to have a concave surface. In FIG. 3, an illustration of the chamfers is omitted.

As illustrated in FIG. 1 and FIG. 3, the drum-shaped core 13 includes a first flange portion 25 and a second flange portion 26 that are connected to a first end portion and a second end portion that are opposite each other in the direction of the central axis CA of the winding core 12. A first terminal electrode 27 and a third terminal electrode 29 are disposed on the first flange portion 25. A second terminal electrode 28 and a fourth terminal electrode 30 are disposed on the second flange portion 26.

The terminal electrodes 27 to 30 include respective bottom surface electrode portions extending along surfaces of the flange portions 25 and 26 that face in the same direction as the bottom surface 18 of the winding core 12. The terminal electrodes 27 to 30 may include respective end surface electrode portions that are disposed on corresponding outer end surfaces of the flange portions 25 and 26, although this is not illustrated in FIG. 1 and FIG. 3. The bottom surface electrode portions are formed by, for example, baking of a conductive paste that contains Ag. The end surface electrode portions can be formed by, for example, sputtering of NiCr and subsequently sputtering of NiCu after the bottom surface electrode portions are formed. The outer surfaces of the terminal electrodes 27 to 30 are preferably plated with, for example, Cu, Ni, and Sn in this order.

End portions of the first wire 15 are connected to the first terminal electrode 27 and the second terminal electrode 28. End portions of the second wire 16 are connected to the third terminal electrode 29 and the fourth terminal electrode 30. The end portions are connected thereto by, for example, thermo-compression bonding or laser welding.

As partly illustrated in FIG. 1 and FIG. 3, the coil component 11 may also include the plate core 31. The plate core 31 is stuck to the surfaces of the drum-shaped core 13 opposite the surfaces of the flange portions 25 and 26 that are seen in FIG. 1. The plate core 31 is composed of a non-magnetic material such as alumina, a magnetic material such as Ni—Zn ferrite, or a resin as in the drum-shaped core 13. Also, in the case of the plate core 31, examples of the resin include a resin that contains magnetic powder such as metal powder or ferrite powder, a resin that contains non-magnetic material powder such as silica powder, and a resin that contains no filler such as powder. When the drum-shaped core 13 and the plate core 31 are composed of a magnetic material, the plate core 31 is disposed so as to connect the first and second flange portions 25 and 26 to each other, and the drum-shaped core 13 forms a magnetic material in conjunction with the plate core 31. For example, the dimension of the plate core 31 in the length direction is about 3.2 mm, the dimension thereof in the width direction is about 2.5 mm, and the dimension thereof in the thickness direction is about 0.7 mm.

The twisted portions extend from the first nodes to the last nodes of the first wire 15 and the second wire 16 that are connected to the terminal electrodes 27 to 30. In this case, there no twisted portions from the terminal electrodes 27 to 30 to positions at which the first wire 15 and the second wire 16 are wound around the winding core 12. The winding of the first wire 15 and the second wire 16 around the winding core 12 may start in a non-twist state, the twisted portions may be formed at an intermediate position of the winding around the winding core 12, subsequently, the winding around the winding core 12 may be in the non-twist state again and end. The length of portions that are not twisted is preferably less than 20% of the entire length of the first wire 15 and the second wire 16 (0% is excluded), or the number of turns between the first end and second end of the winding is preferably about 1 to 2 turns. In the case of the non-twist state, the degree of freedom of wiring when the wires 15 and 16 and the terminal electrodes 27 to 30 are connected is improved.

Before the first wire 15 and the second wire 16 in the twist state are wound around the winding core 12 as above, a first end portion of the first wire 15 and a first end portion of the second wire 16 are typically connected to the first terminal electrode 27 and the third terminal electrode 29. Subsequently, the first wire 15 and the second wire 16 are spirally wound around the circumferential surfaces of the winding core 12 in the same direction from the first flange portion 25 to the second flange portion 26 multiple times while the first wire 15 and the second wire 16 are twisted. At this time, the first wire 15 and the second wire 16 form the twisted portions 32 having plural turns. The first wire 15 and the second wire 16 are not electrically connected to each other because the first wire 15 and the second wire 16 are coated with an insulator and connected to the different terminal electrodes as described above.

FIGS. 4A-4D schematically illustrate states where the circumferential surfaces of the winding core 12 are unfolded in order of the first side surface 19, the top surface 17, the second side surface 20, and the bottom surface 18. In FIGS. 4A-4D, twist states of the twisted portions 32 of the first wire 15 and the second wire 16 are illustrated in a direction perpendicular to the first side surface 19, the top surface 17, the second side surface 20, and the bottom surface 18 from the circumference of the winding core 12 to the central axis CA. In FIGS. 4A-4D, the first wire 15 is illustrated by a thick line, and the second wire 16 is illustrated by a double line. Among intersecting portions of the first wire 15 and the second wire 16, portions that are located at upper positions are illustrated by solid lines, and portions that are located at lower positions are illustrated by dashed lines.

Figures 4A, 4B, 4C, 4D:
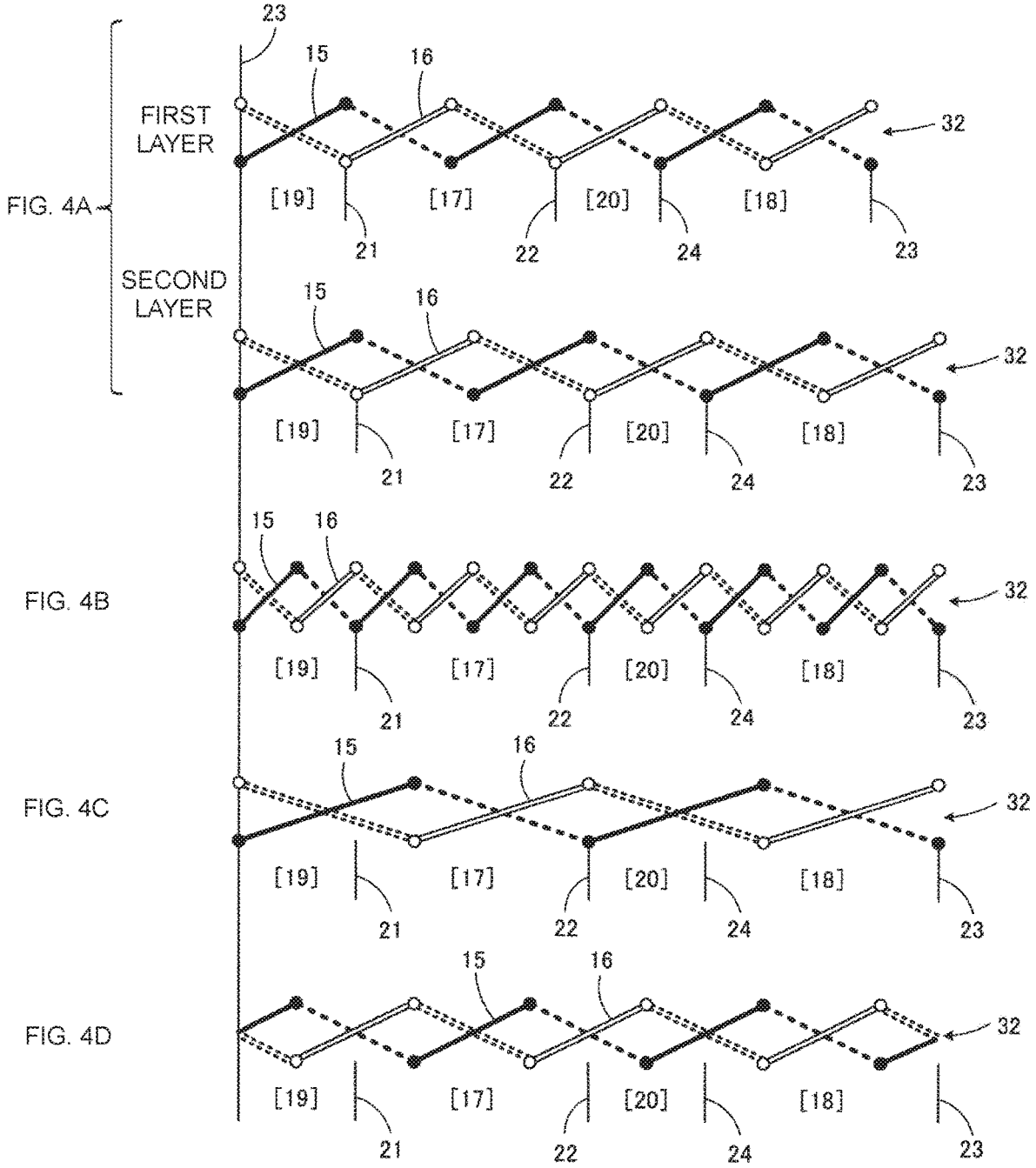
FIGS. 4A-4D schematically illustrate states where circumferential surfaces of the winding core are unfolded in order of a first side surface, a top surface, a second side surface, and a bottom surface, and illustrates twist states of twisted portions of a first wire and a second wire that form a first layer and a second layer around the winding core in a direction perpendicular to the first side surface, the top surface, the second side surface, and the bottom surface from the circumference of the winding core to the central axis, in which the first layer is illustrated at the uppermost position, and the second layer is illustrated just below the first layer. In particular, the second layer of the coil component according to the first embodiment illustrated in FIG. 1 is illustrated at FIG. 4A. A second layer of a coil component according to a second embodiment is illustrated at FIG. 4B. A second layer of a coil component according to a third embodiment is illustrated at FIG. 4C. A second layer of a coil component according to a fourth embodiment is illustrated at FIG. 4D.

Referring to the "first layer" in FIG. 4A, the twist number of the first wire 15 and the second wire 16 that are twisted is about 0.5 above the first side surface 19 in the first layer that is in contact with the winding core 12. That is, when viewed from the outside of the circumferential surfaces of the winding core 12 to the central axis CA of the winding core 12, the anti-nodes of the twisted portions 32 of the first wire 15 and the second wire 16 are on the ridge lines 23 and 21 that are located along the edge portions of the first side surface 19 opposite each other in the circumferential direction, and the first wire 15 and the second wire 16 are arranged in the direction of the ridge lines 23 and 21 and are in close contact with the ridge lines 23 and 21. One of the nodes of the twisted portions 32 of the first wire 15 and the second wire 16 is located near the midpoint of the first side surface 19 in the circumferential direction.

The twist number of the first wire 15 and the second wire 16 that are subsequently twisted is about 1 above the top surface 17. The anti-nodes of the twisted portions 32 of the first wire 15 and the second wire 16 are on the ridge lines 21 and 22 that are located along the edge portions of the top surface 17 opposite each other in the circumferential direction, and the first wire 15 and the second wire 16 are arranged in the direction of the ridge lines 21 and 22 and are in close contact with the ridge lines 21 and 22. Another anti-node of the twisted portions 32 of the first wire 15 and the second wire 16 is located near the midpoint of the top surface 17 in the circumferential direction. The nodes of the twisted portions 32 of the first wire 15 and the second wire 16 are located at two positions of a position of about a quarter of the dimension of the top surface 17 in the circumferential direction and a position of about three quarters of the dimension thereof.

The twist number of the first wire 15 and the second wire 16 that are subsequently twisted is about 0.5 above the second side surface 20. The anti-nodes of the twisted portions 32 of the first wire 15 and the second wire 16 are on the ridge lines 22 and 24 that are located along the edge portions of the second side surface 20 opposite each other in the circumferential direction, and the first wire 15 and the second wire 16 are arranged in the direction of the ridge lines 22 and 24 and are in close contact with the ridge lines 22 and 24. One of the nodes of the twisted portions 32 of the first wire 15 and the second wire 16 is located near the midpoint of the second side surface 20 in the circumferential direction.

The twist number of the first wire 15 and the second wire 16 that are subsequently twisted is about 1 above the bottom surface 18. The twisted portions 32 of the first wire 15 and the second wire 16 above the bottom surface 18 are also illustrated in FIG. 1. In FIG. 1, the first wire 15 and the second wire 16 are twisted together with a gap interposed therebetween. However, the first wire 15 and the second wire 16 may be twisted together with the wire 15 and the second wire 16 in close contact with each other. The anti-nodes of the twisted portions 32 of the first wire 15 and the second wire 16 are on the ridge lines 24 and 23 that are located along the edge portions of the bottom surface 18 opposite each other in the circumferential direction, and the first wire 15 and the second wire 16 are arranged in the direction of the ridge lines 24 and 23 and are in close contact with the ridge lines 24 and 23. Another anti-node of the twisted portions 32 of the first wire 15 and the second wire 16 is located near the midpoint of the bottom surface 18 in the circumferential direction. The nodes of the twisted portions 32 of the first wire 15 and the second wire 16 are located at two positions of a position of about a quarter of the dimension of the bottom surface 18 in the circumferential direction and a position of about three quarters of the dimension thereof.

After that, the first wire 15 and the second wire 16 that form the first layer are twisted in the same manner as above a predetermined number of times while being spirally wound around the winding core 12. The twist pitch of the twisted portions 32 of the first wire 15 and the second wire 16 that form the first layer corresponds to the length of one twist of the first wire 15 and the second wire 16 that are twisted together, that is, a length when the first wire 15 and the second wire 16 return to the initial relative positions for the first time. Accordingly, the twist pitch of the twisted portions 32 in the first layer corresponds to the length of the top surface 17 and the bottom surface 18 in the circumferential direction, or about twice the length of the side surfaces 19 and 20 in the circumferential direction.

Figure 5:
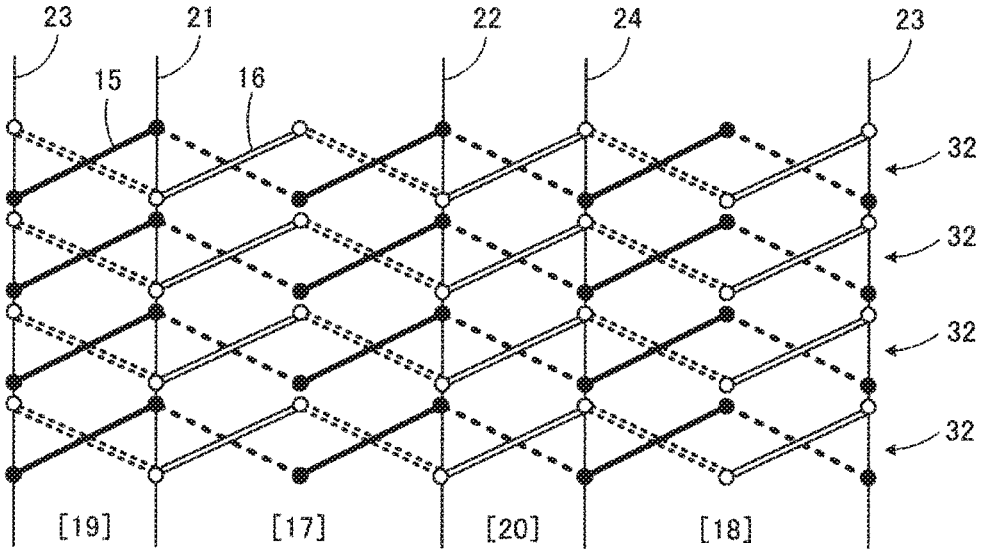
FIG. 5 schematically illustrates states where the circumferential surfaces of the winding core are unfolded in the same manner as in FIG. 4 and illustrates the twist states of the twisted portions of the first wire and the second wire in the first layer that are included in the coil component illustrated in FIG. 1 and that have plural turns.

In the above winding state, as illustrated in FIG. 1 and FIG. 5, the anti-nodes and the nodes of the twisted portions 32 at a turn are aligned with those at a turn adjacent thereto above the first side surface 19, the top surface 17, the second side surface 20, and the bottom surface 18 of the winding core 12. In the first layer, increase in the volume component and instability, which can occur in the same wire, can be reduced. This reduces the mode conversion characteristics of the common mode choke coil. FIG. 5 schematically illustrates states where the circumferential surfaces of the winding core 12 are unfolded in the same manner as in FIGS. 4A-4D. In FIG. 5, components that correspond to the components illustrated in FIGS. 4A-4D are designated by like reference characters.

The positions of the anti-nodes of the twisted portions 32 are set by the ridge lines 21 to 24 of the winding core 12. This inhibits the nodes and the anti-nodes of the twisted portions 32 from being misaligned. Accordingly, electric balance between the first wire 15 and the second wire 16 can be improved. Accordingly, the difference between a stray capacitance related to the first wire 15 and a stray capacitance related to the second wire 16 can be decreased. An inductance and a capacitance that affect a signal that passes through the first wire 15 and the second wire 16 can be equalized or substantially equalized. The mode conversion characteristics of the common mode choke coil can be reduced.

The second layer of the twisted portions 32 of the first wire 15 and the second wire 16 is subsequently wound above the first layer. Here, bank winding is used. For transition from the first layer to the second layer, as illustrated in FIG. 1, the twisted portions 32 return through a first transition portion S1 from the end of a winding region in the first layer to an intermediate position of the winding region in the first layer. The winding in the second layer starts from the intermediate position of the winding region in the first layer. In FIG. 1, the first transition portion S1 extends in the direction illustrated by a dashed line S1-S1. In FIG. 1, the first transition portion S1 is also twisted.

When the twist number of the first transition portion S1 is equal to the twist number of the twisted portions 32 in the first layer and the second layer described later, the first transition portion S1 extends diagonally across the first layer, and the twist pitch of the first transition portion S1 increases accordingly. The twist pitch of the first transition portion S1 is thus longer than the twist pitch in the first layer. However, the twist pitch of the first transition portion S1 can be longer or smaller than the twist pitch in the second layer depending on the number of the turns in the first layer across which the first transition portion S1 extends. The first transition portion S1 may not be twisted.

With regard to the "second layer" shown in FIG. 4A, the twist states of the twisted portions 32 of the first wire 15 and the second wire 16 in the second layer are schematically illustrated with the circumferential surfaces of the winding core 12 unfolded in order of the first side surface 19, the top surface 17, the second side surface 20, and the bottom surface 18.

The length of the circumference of the second layer of the twisted portions 32 of the first wire 15 and the second wire 16 is longer than the length of the circumference of the first layer of the same twisted portions 32. FIG. 2 schematically illustrates the twisted portions 32 of the first wire 15 and the second wire 16 as integrated wire-like bodies 35 and 36. The wire-like body 35 illustrated in outline forms the first layer. The wire-like body 36 illustrated by hatching forms the second layer.

As seen from FIG. 2, the length of the circumference of the wire-like body 36 that forms the second layer is longer than the length of the circumference of the wire-like body 35 that forms the first layer. How much the length of the circumference of the wire-like body 36 that forms the second layer is longer than the length of the circumference of the wire-like body 35 that forms the first layer varies depending on, for example, the arrangement of the first wire 15 and the second wire 16 that form the first layer on the ridge lines 21 to 24.

The twist pitch of the twisted portions 32 varies more greatly as the length of the circumference of the second layer is longer than the length of the circumference of the first layer. That is, in a process of winding the wires 15 and 16, the twist pitch is changed during the transition from the first layer to the second layer. In FIG. 2, the fact that the dimension of a display region of the "second layer" in the length direction is longer than the dimension of a display region of the "first layer" in the length direction means that the length of the circumference is long. According to the first embodiment, as illustrated in FIG. 4A, in the "second layer", the twist number in the second layer per one turn is the same as the twist number in the first layer per one turn.

More specifically, the twist number of the first wire 15 and the second wire 16 that are twisted is about 0.5 at a portion of the second layer along the first side surface 19. The anti-nodes of the twisted portions 32 of the first wire 15 and the second wire 16 are on the ridge lines 23 and 21. The first wire 15 and the second wire 16 are arranged in the direction in which the ridge lines 23 and 21 extend.

The twist number of the first wire 15 and the second wire 16 that are subsequently twisted is about 1 at a portion along the top surface 17. The anti-nodes of the twisted portions 32 of the first wire 15 and the second wire 16 are on the ridge lines 21 and 22. The first wire 15 and the second wire 16 are arranged in the direction in which the ridge lines 21 and 22 extend.

The twist number of the first wire 15 and the second wire 16 that are subsequently twisted is about 0.5 at a portion along the second side surface 20. The anti-nodes of the twisted portions 32 of the first wire 15 and the second wire 16 are on the ridge line 22 and 24. The first wire 15 and the second wire 16 are arranged in the direction in which the ridge lines 22 and 24 extend.

The twist number of the first wire 15 and the second wire 16 that are subsequently twisted is about 1 at a portion along the bottom surface 18. The twisted portions 32 of the first wire 15 and the second wire 16 at the portion along the bottom surface 18 are also illustrated in FIG. 1. The anti-nodes of the twisted portions 32 of the first wire 15 and the second wire 16 are on the ridge lines 24 and 23. The first wire 15 and the second wire 16 are arranged in the direction in which the ridge lines 24 and 23 extend.

After that, the twisted portions 32 of the first wire 15 and the second wire 16 that form the second layer are twisted in the same manner as above a predetermined number of times while being spirally wound around the winding core 12. The twist number of the twisted portions 32 that form the second layer per one turn is the same as the twist number of the twisted portions 32 that form the first layer per one turn. The length of the circumference of the second layer is longer than the length of the circumference of the first layer, and the twist pitch in the second layer is longer than that in the first layer accordingly.

In the winding states of the twisted portions 32 of the first wire 15 and the second wire 16 described above, the following features can be found.

Regarding a turn in the first layer and a turn adjacent thereto in the second layer, when viewed from above the circumferential surfaces of the winding core 12, the twist pitch at the turn in the second layer is longer than that in the first layer.

Regarding a turn in the first layer and a turn adjacent thereto in the second layer, the twist pitch at the turn in the second layer is longer than that in the first layer as a whole.

Over the entire twisted portions 32, the twist pitch in the second layer is longer than the twist pitch in the first layer.

In FIG. 1, the number of the turns of the twisted portions 32 that form the second layer is one. However, the number of the turns may be increased.

Subsequently, the second transition portion S2 makes transition of the twisted portions 32 from the second layer to the first layer. The second transition portion S2 extends in the direction illustrated by a dashed line S2-S2 in FIG. 1. The second transition portion S2 is also twisted. The twist number of the second transition portion S2 is equal to the twist number of the twisted portions 32 in the first layer and the second layer as in the first transition portion S1. In this case, the value of the twist pitch of the second transition portion S2 is preferably selected from values between the twist pitch in the first layer and the twist pitch in the second layer. The second transition portion S2 may not be twisted.

Subsequently, the twisted portions 32 are wound so as to form the first layer in contact with the winding core 12 near the second flange portion 26 of the winding core 12. At this time, the twisted portions 32 are wound in the same manner as the case of the description with reference to the "first layer" in FIG. 4A, and a description thereof is omitted. The twist pitch of the twisted portions 32 that form the first layer is equal to the twist pitch of the twisted portions 32 that are wound near the first flange portion 25 of the winding core 12 described above and that form the first layer. More specifically, the twist pitch of the twisted portions 32 that are wound near the second flange portion 26 of the winding core 12 and that form the first layer is equal to the twist pitch of the twisted portions 32 that are wound near the first flange portion 25 of the winding core 12 and that form the first layer above the first side surface 19, the top surface 17, the second side surface 20, and the bottom surface 18 of the winding core 12.

Subsequently, the third transition portion S3 makes transition of the twisted portions 32 from the first layer to the second layer. The third transition portion S3 extends in the direction illustrated by a dashed line S3-S3 in FIG. 1. The third transition portion S3 is also twisted.

Subsequently, the twisted portions 32 of the first wire 15 and the second wire 16 in the second layer are wound on the first layer. The fourth transition portion S4 makes transition of the twisted portions 32 from the second layer to the first layer. The fourth transition portion S4 extends in the direction illustrated by a dashed line S4-S4 in FIG. 1. Finally, a second end portion of the first wire 15 and a second end portion of the second wire 16 are connected to the second terminal electrode 28 and the fourth terminal electrode 30.

According to the above first embodiment, the twist number in the first layer per one turn is equal to the twist number in second layer per one turn. However, the twist numbers may differ from each other as described below according to second and third embodiments.

The second embodiment will be described with reference to the "first layer" and the "second layer" as shown in FIG. 4B. According to the second embodiment, the "first layer" is as shown in FIG. 4A, and the "second layer" is as shown in FIG. 4B, in which the twist number in the second layer per one turn is larger than, for example twice, the twist number in the first layer per one turn.

More specifically, the twist number of the first wire 15 and the second wire 16 that are twisted is about 1 at a portion along the first side surface 19 in the second layer.

The twist number of the first wire 15 and the second wire 16 that are subsequently twisted is about 2 at a portion along the top surface 17.

The twist number of the first wire 15 and the second wire 16 that are subsequently twisted is about 1 at a portion along the second side surface 20.

The twist number of the first wire 15 and the second wire 16 that are subsequently twisted is about 2 at a portion along the bottom surface 18.

As described at the "first layer" in FIG. 4A, the wires in the first layer are twisted in the same manner as in the first embodiment. The form of the winding of the twisted portions 32 in the first layer and the second layer and the form of transition between the first layer and the second layer are the same as in the first embodiment.

According to the second embodiment, the twist number in the second layer per one turn is larger than that according to the first embodiment. As the twist number in the second layer per one turn thus increases, the first wire 15 and the second wire 16 that form the second layer are more readily handled as with one wire. The twisted portions 32 that are formed by the first wire 15 and the second wire 16 that form the second layer can be wound with improved precision.

However, it is to be noted that merely increasing the twist number as above is not always a good idea. The reason is that when the twist number is too large, there is a concern that the wires 15 and 16 are cut due to friction between the wires 15 and 16. In view of this, the twist number is preferably equal to or less than 2 and is more preferably no less than 0.5 and no more than 1 (i.e., from 0.5 to 1) per one surface of the circumferential surfaces of the winding core 12.

The third embodiment will be described with reference to the "first layer" as shown in FIG. 4A and the "second layer"

as shown in FIG. 4C. According to the third embodiment, with the "first layer" as shown in FIG. 4A and the "second layer" as shown in FIG. 4C, the twist number in the second layer per one turn is less than, for example two thirds of, the twist number in the first layer per one turn.

More specifically, the twist number of the first wire 15 and the second wire 16 that are twisted is about 1 at a portion along the first side surface 19 and the top surface 17 in the second layer.

The twist number of the first wire 15 and the second wire 16 that are subsequently twisted is about 1 at a portion along the second side surface 20 and the bottom surface 18.

As described at the "first layer" in FIG. 4A, the wires in the first layer are twisted in the same manner as in the first embodiment. The form of the winding in the first layer and the second layer and the form of transition between the first layer and the second layer are the same as in the first embodiment.

The fourth embodiment will be described with reference to the "first layer" as shown in FIG. 4A and the "second layer" as shown in FIG. 4D. According to the fourth embodiment, with the "first layer" as shown in FIG. 4A and the "second layer" as shown in FIG. 4D, the twist number in the first layer per one turn is equal to the twist number in the second layer per one turn as in the first embodiment. According to the fourth embodiment, as seen from comparison between the second layer as shown in FIG. 4A and the second layer as shown in FIG. 4D, the twisted portions 32 in the second layer shift by a quarter of the twist pitch as compared to the second layer according to the first embodiment. Accordingly, the anti-nodes of the twisted portions 32 in the first layer and the nodes of the twisted portions 32 in the second layer are aligned in the radial direction of the winding core 12, and the nodes of the twisted portions 32 in the first layer and the anti-nodes of the twisted portions 32 in the second layer are aligned in the radial direction of the winding core 12.

The meaning of the term "radial direction" is not limited to the direction of the diameter or the radius of a substantially circular section but includes the direction of the diameter of a polygonal section, that is, a "diagonal" direction.

Selecting the positional relationship in the nodes and the anti-nodes between the first layer and the second layer in the above manner enables the twist, particularly, in the second layer to be stable. This is typically expressed such that selecting the positions of the nodes and the anti-nodes in the n-th layer (n is a natural number) and the (n+1)-th layer in the above manner enables the twist, particularly, in the (n+1)-th layer to be stable.

The other structure according to the fourth embodiment is the same as that according to the first embodiment. The transition portions that connect the first layer and the second layer to each other can be used for adjustment in the twist pitch.

According to the first to fourth embodiments described above, the twist number of the twisted portions 32 in each layer per one turn is a multiple of 0.5. With this structure, the nodes and the anti-nodes of the twisted portions 32 at a turn in one layer can be readily aligned with those at a turn adjacent thereto in the layer and those at a turn adjacent thereto in the other layer.

Figure 6:
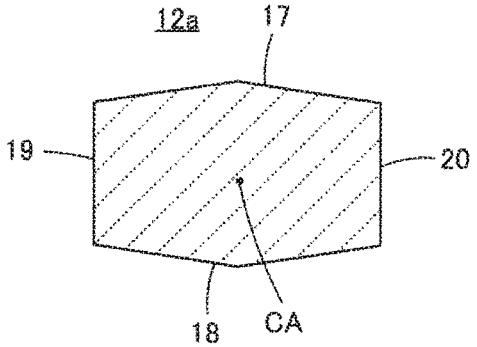
FIG. 6 is a sectional view of a winding core of a coil component according to a fifth embodiment of the present disclosure.
Figure 7:
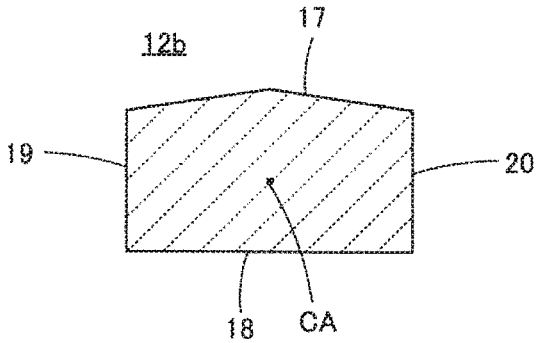
FIG. 7 is a sectional view of a winding core of a coil component according to a sixth embodiment of the present disclosure.

According to the first to fourth embodiments described above, the circumferential surfaces of the winding core 12 include the four flat surfaces that are adjacent to each other and that are arranged in the circumferential direction, that is, the top surface 17, the bottom surface 18, the first side surface 19, and the second side surface 20. A sectional shape of the winding core 12 along the plane perpendicular to the central axis CA of the winding core 12 is a substantially quadrilateral shape each side of which linearly extends. However, modifications that will be described below with reference to FIG. 6 to FIG. 10 can also be used. In FIG. 6 and FIG. 7, components that correspond to the components illustrated in FIG. 2 are designated by like reference characters, and a duplicated description is omitted.

In the case of a winding core 12*a* illustrated in FIG. 6, a sectional shape thereof along the plane perpendicular to the central axis CA is substantially a hexagon that includes three pairs of two sides that are parallel to each other. Six sides that the hexagon has have the same length. A difference from the winding core 12 illustrated in FIG. 2 will now be described with the reference characters in FIG. 2 that illustrates the winding core 12. A sectional shape of the top surface 17 and a sectional shape of the bottom surface 18 project outward and have a bent shape. The winding core 12*a* enables the degree of projection of a corner that is formed by each ridge line of the circumferential surfaces of the winding core 12*a* to be less than that in the winding core 12 that has a substantially quadrilateral section illustrated in FIG. 2. Consequently, the wires can be inhibited from being damaged.

In the case of a winding core 12*b* illustrated in FIG. 7, a sectional shape thereof along the plane perpendicular to the central axis CA is substantially a pentagon that includes a pair of two sides that are parallel to each other. A difference from the winding core 12 illustrated in FIG. 2 will now be described with the reference characters in FIG. 2 that illustrates the winding core 12. A sectional shape of the top surface 17 projects outward and has a bent shape.

Figure 8:
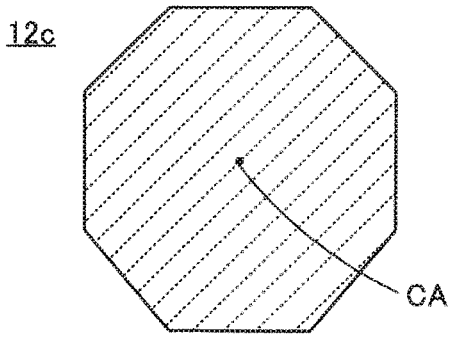
FIG. 8 is a sectional view of a winding core of a coil component according to a seventh embodiment of the present disclosure.

In the case of a winding core 12*c* illustrated in FIG. 8, a sectional shape thereof along the plane perpendicular to the central axis CA is substantially an octagon that includes four pairs of two sides that are parallel to each other. The winding core 12*c* enables the degree of projection of a corner that is formed by each ridge line of the circumferential surfaces of the winding core 12*c* to be less than that in the winding core 12 that has a substantially quadrilateral section illustrated in FIG. 2. Consequently, the wires can be inhibited from being damaged.

Figure 9:
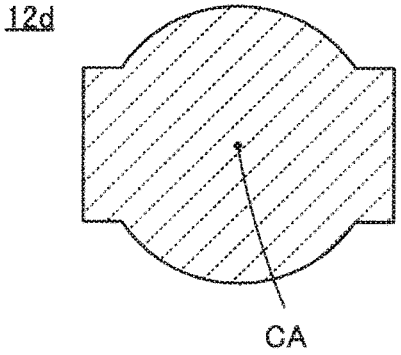
FIG. 9 is a sectional view of a winding core of a coil component according to an eighth embodiment of the present disclosure.

In the case of a winding core 12*d* illustrated in FIG. 9, a sectional shape thereof along the plane perpendicular to the central axis CA is a shape that includes two sides that are parallel to each other, and the other two sides other than the two sides that are parallel to each other each have a convex arc projecting outward.

Figure 10:
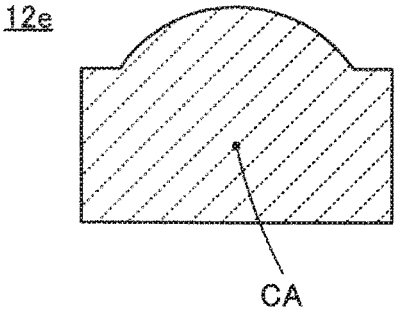
FIG. 10 is a sectional view of a winding core of a coil component according to a ninth embodiment of the present disclosure.
Figure 11A:
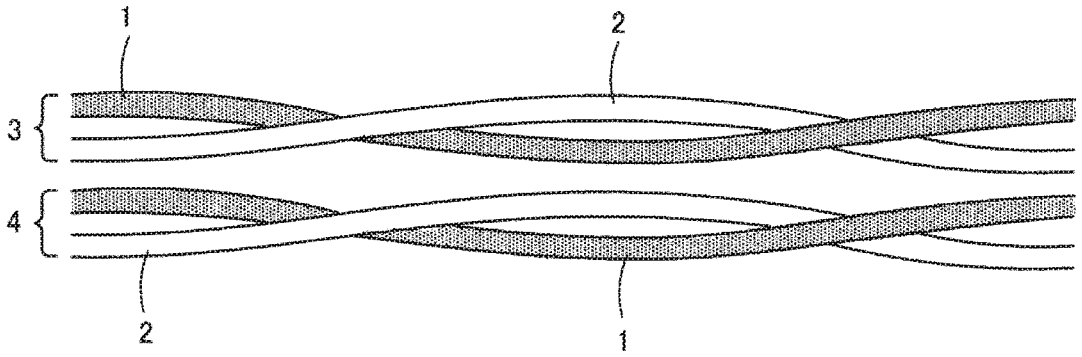
FIGS. 11A and 11B illustrate parts of two adjacent twisted portions with the first wire and the second wire twisted together.
Figure 11B:
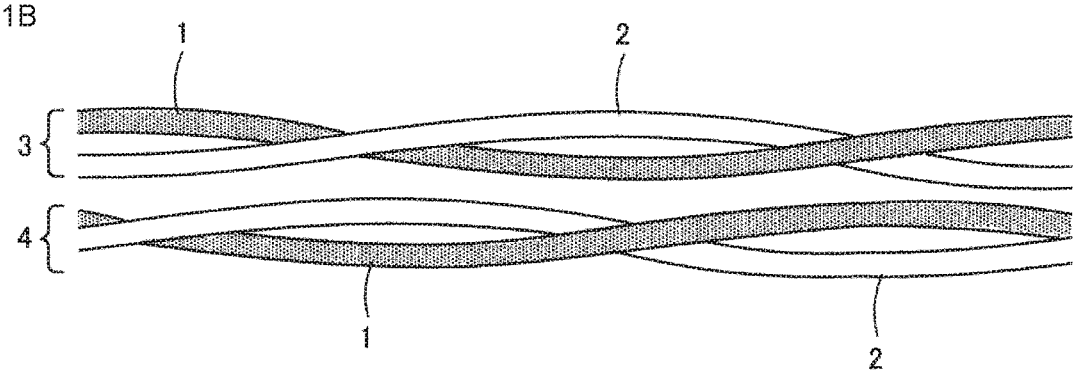
Figure 12:
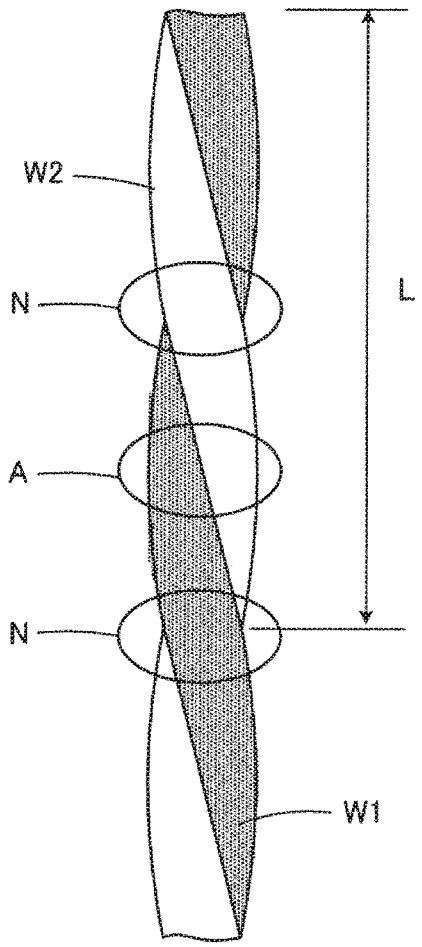
FIG. 12 is an enlarged diagram illustrating a twist state of a first wire and a second wire for description of a twist pitch, a twist number, the nodes, and the anti-nodes.

In the case of a winding core 12*e* illustrated in FIG. 10, a sectional shape thereof along the plane perpendicular to the central axis CA is a shape that includes two sides that are parallel to each other, and another side other than the two sides that are parallel to each other has a convex arc projecting outward.

According to the modifications of the sectional shape of the winding core as above, the degree of freedom of change in the aspect ratio of the sectional shape of the winding core can be increased. For example, the above modifications can be appropriately used to increase the sectional area and improve the inductance without much change in the dimension of the winding core in the height direction.

The present disclosure is described above with the embodiments and the drawings. Various other modifications can be made within the range of the present disclosure.

For example, although the twisted portions 32 of the first wire 15 and the second wire 16 are wound around the winding core 12 so as to form the two layers according to the embodiments described with reference to the drawings, the twisted portions 32 may be wound so as to form three or more layers.

The number of turns of the wining of the first wire 15 and the second wire 16 around the winding core 12 may be freely changed.

The above embodiments relate to the coil component that forms the common mode choke coil. The present disclosure, however, can also be used for a coil component that forms a transformer or a balun.

The embodiments are described above by way of example. Features of the different embodiments may be partially replaced or combined.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a winding core; and a first wire and a second wire that are spirally wound around the winding core, that have substantially the same number of turns, that are not electrically connected to each other, and that have a twisted portion at which the first wire and the second wire are twisted together, wherein the twisted portion is wound around the winding core such that layers are formed, and a twist pitch of the twisted portion at a turn in a first layer differs from a twist pitch of the twisted portion at a turn adjacent thereto in a second layer.

2. The coil component according to claim 1, wherein the twist pitch of the twisted portion in the first layer is shorter than the twist pitch of the twisted portion in the second layer.

3. The coil component according to claim 2, wherein a twist number of the twisted portion in the first layer and in the second layer per one turn is a multiple of 0.5.

4. The coil component according to claim 2, wherein an anti-node of the twisted portion in the first layer and a node of the twisted portion in the second layer are aligned in a radial direction of the winding core, and a node of the twisted portion in the first layer and an anti-node of the twisted portion in the second layer are aligned in the radial direction of the winding core.

5. The coil component according to claim 2, further comprising:

a terminal electrode to which an end portion of the first wire and an end portion of the second wire are connected, wherein a portion of the first wire and a portion of the second wire that are connected to the terminal electrode are not twisted before being wound around the winding core.

6. The coil component according to claim 2, wherein the winding core has circumferential surfaces that are formed by at least four flat surfaces that are adjacent to each other about a central axis, and the twisted portion in the first layer at a turn has the same twist number as that at a turn adjacent thereto on any one of the flat surfaces.

7. The coil component according to claim 2, wherein a sectional shape of the winding core is a polygonal shape including two sides that are parallel to each other.

8. The coil component according to claim 2, wherein a sectional shape of the winding core is a shape that includes two sides that are parallel to each other and that includes another side having a convex arc projecting outward other than the two sides that are parallel to each other.

9. The coil component according to claim 1, wherein the twist pitch of the twisted portion in the first layer is longer than the twist pitch of the twisted portion in the second layer.

10. The coil component according to claim 9, wherein a twist number of the twisted portion in the first layer and in the second layer per one turn is a multiple of 0.5.

11. The coil component according to claim 9, wherein an anti-node of the twisted portion in the first layer and a node of the twisted portion in the second layer are aligned in a radial direction of the winding core, and a node of the twisted portion in the first layer and an anti-node of the twisted portion in the second layer are aligned in the radial direction of the winding core.

12. The coil component according to claim 9, further comprising:

a terminal electrode to which an end portion of the first wire and an end portion of the second wire are connected, wherein a portion of the first wire and a portion of the second wire that are connected to the terminal electrode are not twisted before being wound around the winding core.

13. The coil component according to claim 9, wherein the winding core has circumferential surfaces that are formed by at least four flat surfaces that are adjacent to each other about a central axis, and the twisted portion in the first layer at a turn has the same twist number as that at a turn adjacent thereto on any one of the flat surfaces.

14. The coil component according to claim 1, wherein a twist number of the twisted portion in the first layer and in the second layer per one turn is a multiple of 0.5.

15. The coil component according to claim 1, wherein an anti-node of the twisted portion in the first layer and a node of the twisted portion in the second layer are aligned in a radial direction of the winding core, and a node of the twisted portion in the first layer and an anti-node of the twisted portion in the second layer are aligned in the radial direction of the winding core.

16. The coil component according to claim 1, further comprising:

a terminal electrode to which an end portion of the first wire and an end portion of the second wire are connected, wherein a portion of the first wire and a portion of the second wire that are connected to the terminal electrode are not twisted before being wound around the winding core.

17. The coil component according to claim 1, wherein the winding core has circumferential surfaces that are formed by at least four flat surfaces that are adjacent to each other about a central axis, and the twisted portion in the first layer at a turn has the same twist number as that at a turn adjacent thereto on any one of the flat surfaces.

18. The coil component according to claim 1, wherein a sectional shape of the winding core is a polygonal shape including two sides that are parallel to each other.

19. The coil component according to claim 1, wherein a sectional shape of the winding core is a shape that includes two sides that are parallel to each other and that includes another side having a convex arc projecting outward other than the two sides that are parallel to each other.

20. A method of manufacturing a coil component, the method comprising:

preparing a winding core;

preparing a first wire and a second wire;

a first winding operation of spirally winding the first wire and the second wire around the winding core after the first wire and the second wire are twisted together; and a second winding operation of spirally winding the first wire and the second wire around the winding core while the first wire and the second wire are twisted together such that the first wire and the second wire are stacked on the first wire and the second wire that are wound during the first winding operation, wherein a twist pitch of the first wire and the second wire that are twisted during the second winding operation differs from a twist pitch of the first wire and the second wire that are twisted during the first winding operation.

* * * * *